US005567144A

United States Patent [19]

McCoy

[11] Patent Number: 5,567,144

[45] Date of Patent: Oct. 22, 1996

[54] HOT SURFACE IGNITION CONTROLLER FOR FUEL OIL BURNER

[75] Inventor: Hugh W. McCoy, Bowling Green, Ky.

[73] Assignee: Desa International Inc., Bowling Green, Ky.

[21] Appl. No.: 538,988

[22] Filed: Oct. 5, 1995

[51] Int. Cl.[6] ..... F23N 5/08

[52] U.S. Cl. ..... 431/79; 431/66; 431/69; 431/78

[58] Field of Search ..... 431/77, 78, 79, 431/28, 6, 66, 69, 67

[56] References Cited

U.S. PATENT DOCUMENTS

| | | | |
|---|---|---|---|
| 3,393,039 | 7/1968 | Eldridge, Jr. et al. . | |
| 3,537,804 | 11/1970 | Walbridge | 431/66 |
| 3,572,811 | 3/1971 | Hron | 431/69 |
| 3,651,327 | 3/1972 | Thomson | 250/217 E |
| 3,713,766 | 1/1973 | Donnelly et al. | 431/69 |
| 3,741,709 | 6/1973 | Clark | 431/79 |
| 4,643,668 | 2/1987 | Geary | 431/78 |
| 5,026,270 | 6/1991 | Adams | 431/69 |
| 5,085,573 | 2/1992 | Geary | 431/6 |
| 5,133,656 | 7/1992 | Peterson | 431/78 |

*Primary Examiner*—James C. Yeung
*Attorney, Agent, or Firm*—Jones, Day, Reavis & Pogue

[57] ABSTRACT

A fuel oil burner utilizing a hot surface ignition with an ignitor that is fully sintered and has essentially no porosity, a circuit for applying AC line voltage to the ignitor and to a blower motor, an AC-to-DC converter for providing twelve volts DC for operation of a control circuit that has a first time constant circuit for preheating the ignitor and maintaining the ignitor at an ignition temperature for a predetermined ignition trial period of time, a second time constant circuit for starting the blower motor and providing fuel to the combustion chamber for a predetermined time concurrent with the ignition trial period, and a third time constant circuit that either maintains the fan blower in its energized state if a flame of sufficient magnitude and frequency is detected and for de-energizing the blower motor if the flame is not detected in less than one second after the ignitor is de-energized. A lock-out circuit is provided such that if no flame is detected, the unit cannot be restarred without first removing power and then reapplying power to the unit.

12 Claims, 2 Drawing Sheets

HOT SURFACE IGNITION CONTROLLER FOR FUEL OIL BURNER

BACKGROUND OF THE INVENTION

1. Field of the Invention

The present invention relates to the control of fuel burning devices in general and in particular relates to a fuel oil burner using a hot surface ignitor electrode that is sintered to full density with no porosity and which further includes a control assembly that preheats the ignitor and then provides a trial ignition during which time the blower motor and the fuel oil are provided to the combustion chamber. If a flame is not detected in less than one second, the device is de-energized and starting must be retried.

2. Description of Related Art

Portable forced air kerosene heaters typically comprise an outer housing surrounding a combustion chamber. Air is forced into the combustion chamber. A burner is located at one end of the combustion chamber and the burner normally has a fuel nozzle frequently incorporating eductor means providing jets of air to draw, mix, and atomize the fuel delivered by the nozzle. The nozzle, together with the eductors, discharges a combustible fuel-air mixture into the combustion chamber. An ignitor is provided to ignite the mixture and, after initial ignition, continuous burning occurs. Typically, during the continuous combustion, forced air heat currents issue from the end of the heater opposite the burner and additional heat radiates from the surface of the heater housing.

Portable space heaters of the general type described are frequently provided with a direct spark type of ignitor and a motor. The motor normally runs a fan supplying air to the combustion chamber and the eductors and operates a fuel pump or air compressor to supply the fuel to the combustion chamber.

When the portable space heater is functioning properly, fuel burning will occur near the end of the combustion chamber at which the burner is located. In the event of reduced air flow, however, the flame will move toward the opposite end of the combustion chamber, the oxygen supply becoming inadequate for proper combustion. Under such a circumstance, it is desirable to shut down the heater. Inadequate air may result because of a malfunction of the fan or a blocking of the passages for air into or out of the combustion chamber.

Inadequate operation and possibly dangerous conditions may also be indicated by a lower than normal temperature of the burner flame, representing improper combustion conditions.

It is also desirable to shut down the portable space heater when there is a flame failure. This can occur by virtue of faulty ignition, a blockage of the fuel nozzle, or exhaustion of the fuel supply.

Further, many of the prior art portable, fuel oil fired, heaters utilize a spark gap for ignition. (Some use heating coils that glow at a particular temperature sufficiently hot to cause ignition of gaseous-type fuel.)

Hot surface ignition systems (HSI) have been used for more than twenty years for gas ignition in units such as gas clothes dryers, gas ovens, gas fired furnaces, and boilers thus replacing and eliminating standing gas pilot lights. Low voltage ignitors (12 and 24 volts) of the hot surface type are made from a patented ceramic/intermetallic material. These ignitors were used in compact low wattage assemblies for gas fired ignition. The element reaches ignition temperature in less than 3–5 seconds and utilizes about 40 watts of power. The ignitor is made from a composite of strong oxidation resistant ceramic and a refractory intermetallic. Thus hot surface ignitors have no flame or spark. They simply heat to the required temperature for igniting a fuel air mixture. Such ignitors have not been used in oil burning systems because the ignitor material is porous and oil entering the porous cavities causes buildup of the materials that are inimical to the operation of the burner.

A 100 to 240 V HSI ignitor has been developed in which the material is compressed and sintered to full density leaving no porosity resulting in a high performance ceramic composite. It can operate at very high temperatures such as 1,300° to 1,600° C. The application of such high voltage hot surface ignition device is especially attractive for use in the present invention wherein oil fuel burning heaters are to be constructed. They provide unique advantages over prior art gas flames, heating coils, and spark gap ignition systems.

In any case, malfunctions in the prior art heaters can cause insufficient or incomplete burning or a failure to burn issuing fuel thus producing a dangerous existence of highly flammable liquid or noxious fumes. Prior art devices include a number of safety control circuits for fuel burning devices proposed to avoid the many and often undesirable results of improper burning or failure of flame in apparatus such as portable space heaters.

Thus, in U.S. Pat. No. 3,713,766 a pretrial ignition period is determined by a bimetallic thermal switch which, after a predetermined period of time if ignition has not started, opens and removes the power. Manual resetting of the bimetallic contacts is required to restart. However, during burner operation, if the flame for any reason goes out, a new trial period is automatically reinitiated. This could be dangerous if a fuel buildup in the combustion chamber is ignited. Further, if the photocell detecting the flame is shorted during operation, the burner will continue to operate because the circuit cannot detect that the photocell has been shorted. In such case, the unit thinks that there is a flame because, when there is a flame, the photocell resistance is very low, similar to a short. This control requires a dark chamber to start. However, this control does not lockout if start-up is negated because of light in the chamber, undesirable results can occur. Thus in a case where a cover was removed, the control can start the motor if a person comes close enough to block the light. Further, spark ignition is constantly applied during each cycle of the line voltage applied. Finally, there is an electric spark ignition circuit.

In U.S. Pat. No. 3,651,327, a fluctuating control signal, due to flame fluctuation, is rectified and energizes a control device that is a relay. This circuit is entirely a DC circuit. It responds only to the presence or absence of a flame and would require a separate circuit for a trial ignition period. It has no start-up circuit or restart circuit, no preheat circuit and no hot surface ignition.

In U.S. Pat. No. 3,672,811, apparently a gas-type heater, if the photocell shorts during operation, there is no detection of loss of flame. Thus there is no shutdown of the fuel flow or the air blower. It also uses spark gap ignition with a continuous spark being applied. There is no hot surface ignition.

In U.S. Pat. No. 3,741,709 there is no shutdown of the control system if the photocell shorts during operation. There is no ignition preheat period, no ignition trial period, constant ignition, and no hot surface ignition device.

In U.S. Pat. No. 3,393,039, if the unit fails to start during an ignition period, a resistance heater opens the contacts of a thermal contact unit to remove power. It utilizes only AC voltage, uses a mechanical relay to cause continued operation of the circuit by detecting the heat of the flames and has an automatic restart. It is not shutdown during operation if the flame is gone. It simply keeps trying to ignite. There is no hot surface ignition.

In U.S. Pat. No. 3,537,804, an ignitor coil is used rather than a spark gap or pilot flame. The temperature of the ignitor coil is sensed by a photocell and, when the proper temperature is reached, the fuel valve is opened. It has a trial ignition in which, if a flame does not occur, a heating element opens bimetallic contacts to remove power. If the photocell is shorted during operation, the system simply tries to restart and does not shut down unless the bimetallic switch is opened after a heating element in the circuit reaches a predetermined temperature.

SUMMARY OF THE INVENTION

The present invention relates to a fuel oil type burner having a hot surface ignitor element that is manufactured to full density with no porosity. A blower provides air to the combustion chamber and an AC-to-DC converter circuit converts AC power to a DC voltage output. A first control switch is coupled between the AC power source and the hot surface ignitor electrode for selectively providing the AC power to the hot surface ignitor electrode. A second control switch is coupled between the AC power source and the blower for selectively driving the blower. A flame detector is associated with the combustion chamber for generating a signal if a flame is detected. A control assembly is coupled to the DC output voltage and the flame detector for starting and maintaining the fuel oil burning by initiating an ignitor preheat period and an ignition trial period. The control assembly generates a first signal to the first control switch to couple the ac voltage to the hot surface ignitor to preheat the ignitor for a first predetermined period of time known as the ignitor preheat time. It also provides heat for a second period of time known as the trial ignition time period. It further generates a second signal to the motor for introducing both air and fuel to the combustion chamber at the beginning of the trial ignition period and for a very short period of time immediately following the trial ignition period known as the flame test period. It de-energizes the fan blower motor, which removes the fuel to the burner, if no ignition occurs during the flame test period. A photocell acts as the flame detector and produces both an AC output signal and a DC component output signal that is affected by ambient light. The AC signal has a frequency depending upon the fluctuation of the flame. A photocell flame control circuit includes a capacitor for receiving the output signal from the photocell. It blocks the DC voltage component generated by the photocell to prevent the fuel oil burner blower motor from being energized by the DC signal because of ambient light. It includes a first drive circuit coupled to a first time constant circuit and generates a first signal to preheat the ignitor for the first predetermined preheat time period. It continues to heat the ignitor for the second predetermined trial ignition period of time. A second time constant circuit is coupled to a second drive circuit for energizing the blower motor and providing the fuel oil and air substantially only during the second ignition trial time period. A third time constant circuit is coupled between the photocell and the second drive circuit for maintaining the blower in the energized state if a flame is detected by the photocell.

A flame sensing circuit in the control assembly receives the photocell AC output peak-to-peak amplitude voltage to maintain the third time constant in a charged state if the AC peak-to-peak amplitude and the flame frequency are within predetermined limits. A transistor is biased to the ON condition to prevent a charge from being maintained by the third time constant circuit. It also has an OFF condition that provides a signal that will maintain a charge on the third time constant circuit. If flame signals of amplitude and frequency from the photocell are within predetermined ranges, the transistor is turned OFF with each alternate ½-cycle of the signal frequency thereby enabling a charging voltage to be applied to the third time constant and maintain the charge thereby maintaining the blower in the energized state. Thus the flame sensing circuit that receives the signals from the photocell is frequency sensitive. It is also amplitude sensitive. Therefore, if the flame frequency is within the predetermined range, the third time constant circuit remains charged and when the flame frequency is lower than the predetermined limits the third time constant circuit discharges thus allowing the blower motor to be de-energized. In like manner, when the flame amplitude is of insufficient magnitude to be within the predetermined limits, the third time constant discharges and the blower motor is de-energized.

A lock-out circuit is coupled between the blower drive circuit and the flame sensing circuit transistor to lock it in the ON position with a voltage of such magnitude that it cannot be overcome by any signal from the photocell. This prevents any restart without first shutting off the AC voltage and reapplying it so that the device has to recycle from the beginning.

Thus the present invention provides numerous advantages over the prior art.

First, it uses a hot surface ignition ignitor that can ignite oil without absorbing the oil and inhibiting the function of the hot surface ignitor. Second, it has a very simple electronic circuit that has an ignitor preheat time period, an ignition trial period, and a subsequent flame test period in which, if no flame is apparent, the system shuts down by removing not only the voltage to the ignitor assembly, but also to the fan blower assembly that stops the air and fuel from being provided to the combustion chamber. The system also locks out to prevent restart of motor due to photocell signal (in case the cover is removed while unit is still plugged in.) Further, it provides AC line voltage to the ignitor that provides for wide use of the heaters in areas where alternating current power is available. It also allows the use of high voltage AC to the ignitor and to the blower motor but low voltage DC to the control circuits that can be formed of compact integrated circuits. Further it uses as a flame detector a photocell which has both an AC level and frequency that are detected to determine the establishment of a flame. A time constant circuit is used to control the drive to the blower motor. If the amplitude and frequency of the flame are both correct, the AC portion of the flame signal will turn OFF a transistor each cycle. Each time the transistor is turned OFF, a charging voltage is applied to the time constant circuit. This enables the time constant circuit to be maintained in a charged state thus applying the appropriate voltage to the drive circuit that is enabling the fan blower motor. If the frequency of the flame is correct but the amplitude is too low, even though the transistor has the voltage applied to its base each cycle, the voltage will be of insufficient amplitude to turn the transistor OFF and thus will allow the time constant circuit to discharge. If the voltage level is sufficient but the frequency is too low, the transistor will be turned OFF but not for a sufficient period of time to recharge the time constant circuit thus allowing it to discharge and stop the blower motor. The signal that stops the blower motor is a high level logic signal which is also coupled back to the input of the transistor base thus locking it in the ON position to hold the time constant circuit in the discharged state. Thus the unit cannot be restatted without the AC voltage being disconnected from the unit by turning a master switch OFF and then reapplying the AC voltage thus preventing accidental restart.

Thus it is an object of the present invention to provide a fuel oil type burner that utilizes a hot surface ignitor element associated with a combustion chamber, the ignitor element being sintered to full density with essentially no porosity.

It is another object of the present invention to provide a fuel oil type burner that utilizes AC line voltage of 100 to 240 volts to drive both the ignitor and the blower motor and yet utilizes low voltage DC in its control circuits to control the application of that AC voltage to the ignitor and to the blower motor.

It is yet another object of the present invention to utilize a transistor that is biased to the ON state to cause essentially no voltage to be coupled to a time constant circuit which keeps the fan blower motor de-energized and which has an AC coupled input such that when each negative input pulse of sufficient magnitude from a flame detecting photocell is received, the transistor is turned OFF and a voltage is applied to the time constant circuit to maintain it in a charged state and thus keep the fan motor energized when a proper flame is detected.

It is still another object of the present invention to provide a lock-out circuit which functions to bias the transistor to the ON state whenever flame is lost thus preventing an automatic restart and requiring a manual restart of the unit. However, it permits restart even if a flame exists in the chamber. This allows safe, more controlled burning of any excess fuel collection.

Thus the present invention relates to a fuel oil type burner including a fuel oil combustion chamber, a power source for providing AC line voltage, a hot surface ignitor element associated with the combustion chamber, the ignitor electrode being sintered to full density with essentially no porosity, a fan blower driven by a motor for providing fuel oil and air to the combustion chamber, an AC-to-DC converter coupled to the AC power supply for providing a DC voltage output, a first controllable switch coupled between the AC power source and the hot surface ignitor, a second controllable switch coupled between the AC power source and the fan blower motor, a flame detector associated with the combustion chamber for generating an electrical signal if a flame is detected, and a control assembly coupled to the DC output voltage, the flame detector, and the first and second controllable switches for heating the hot surface ignitor with the AC voltage for a first predetermined preheat period, energizing a blower motor and continuing to heat the hot surface ignitor during a second predetermined trial ignition period, energizing the fan blower motor only at the beginning of the trial ignition period, and for a short flame test period immediately following the trial ignition. If a flame appears but is insufficient to cause a photocell to produce an AC signal of proper amplitude and frequency, or if the flame disappears, the unit is shut down by removing fuel and air to the unit. After shutdown, the unit provides a lock-out mode that prevents accidental restart which makes the heater safer for service personnel.

BRIEF DESCRIPTION OF THE DRAWINGS

These and other more detailed objects of the present invention will be more fully disclosed in the following in which like numerals represent like elements and in which.

DETAILED DESCRIPTION OF THE PRESENT INVENTION

Figure 1:
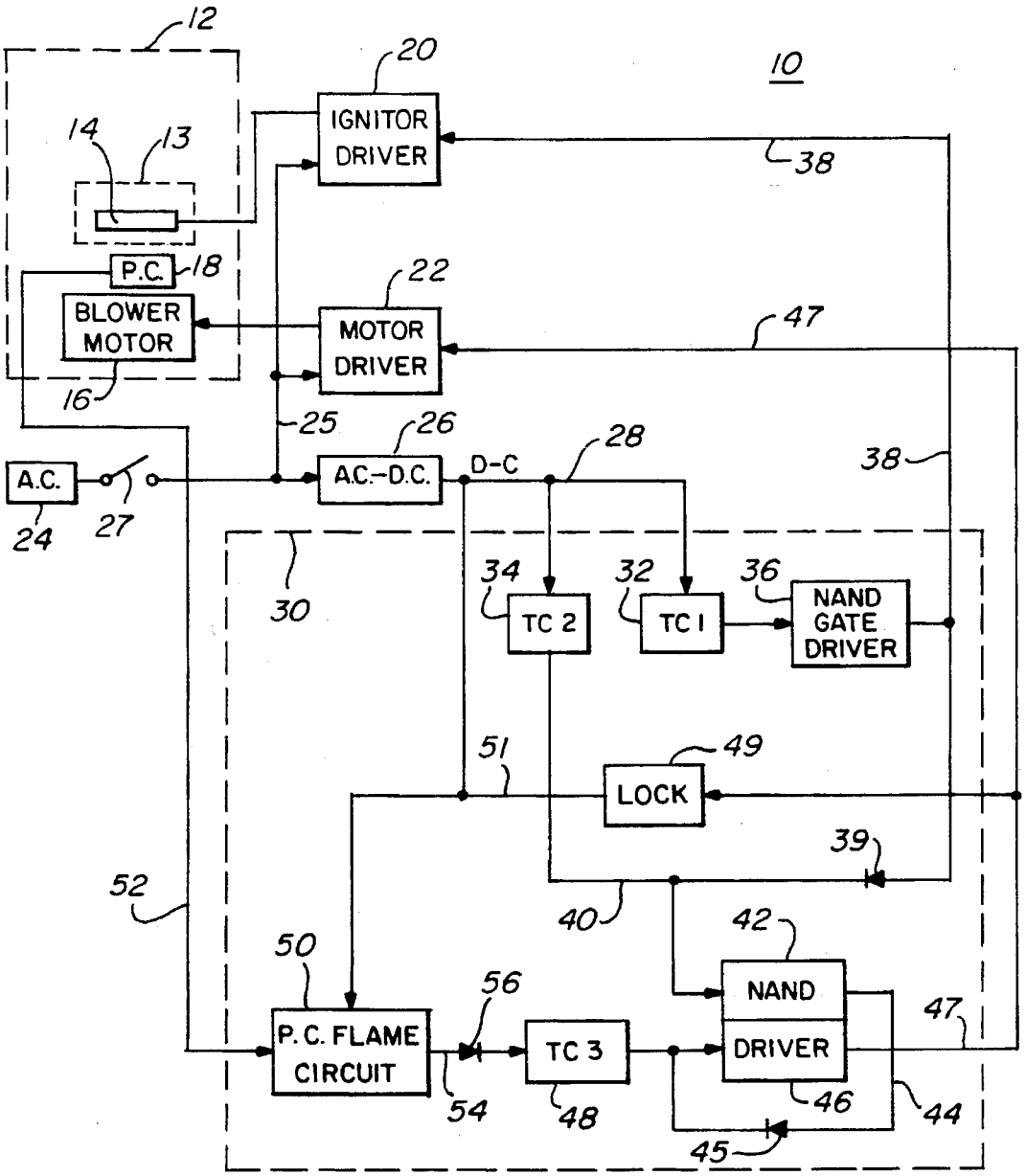
FIG. 1 is a schematic block diagram of the novel invention.
Figure 3:
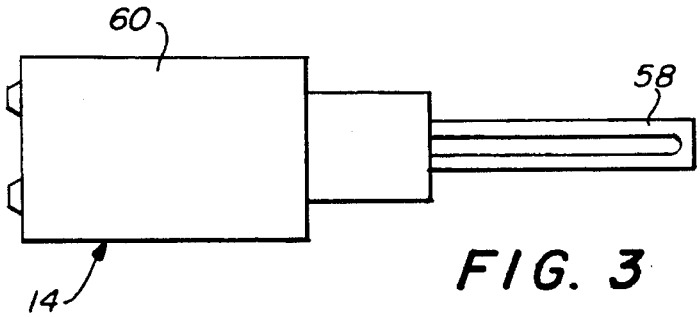
FIG. 3 is a schematic representation of a hot surface ignitor used in the present invention.

FIG. 1 is a schematic block diagram of the novel fuel oil type burner 10 illustrating the combustion housing 12 with the combustion chamber 13 shown therein in phantom lines and at one of which is positioned a hot surface ignitor 14 and, in close proximity thereto a flame sensor or photocell 18. In the housing 12 is a blower motor 16, that not only provides the air for the combustion chamber 12 but also provides the fuel oil. An ignitor driver 20 is coupled to the hot surface ignitor 14 to selectively couple AC line voltage from source 24 on line 25 to the ignitor 14. The line voltage may be 110 V or 220 V AC. In like manner, a motor driver switch 22 selectively couples the alternating current voltage on line 25 to the blower motor 16 to provide the fuel and air to the combustion chamber 12.

The AC voltage source 24 is also coupled through a switch 27 to a well-known AC-to-DC converter 26 that generates a DC output voltage signal on line 28. Typically, the DC voltage may be 12 volts on line 28. When 110 V AC line voltage is provided, R10 has a value of 2.7 K ohms, 5 W. When 220 V AC line voltage is used, R10 has a value of 5.5 K ohms, 10 W.

When the switch 27 is closed and the voltage from source 24 is applied to the AC/DC converter 26, the DC voltage on line 28 commences charging a first time constant circuit 32 and a second time constant circuit 34. For example only, the first time constant 32 may be approximately 10 seconds. Its output is coupled to NAND gate driver 36 whose logic low output on line 38 closes triac switch 20, the ignitor driver, and provides the AC line voltage on line 25 to the hot surface ignitor 14 to begin to heat it. Time constant TC1, represented by block 32, has a time period that lasts for approximately 10 seconds. The first 5 seconds is a preheat period in which the ignitor 14 is being brought to the proper temperature.

At the same time the first time constant 32 begins to function, the second time constant, TC2, represented by block 34, begins to function. Its time constant period is approximately 5 seconds and is coupled on line 40 to NAND gate 42. This causes no output on line 44 which includes diode 45 and is coupled to the input of NAND driver 46 and a third time constant circuit, TC3, represented by block 48. When the 5-second time constant has expired, not only has the ignitor 14 reached proper temperature for an ignition trial, but the output of the second time constant 34 on line 40 goes low to cause a high output from NAND gate 42 on line 44 and through diode 45 to the third time constant 48 and to the input of NAND driver 46. This causes a low output from NAND driver 46 on line 47 to the motor driver circuit 22 to enable it. Drive circuit 22 then couples the AC voltage on line 25 to the blower motor 16 and it commences to provide fuel oil and air to the combustion chamber 12.

The third time constant circuit, TC3, represented by block 48, has a very short time constant period, for example from 0.6 to 0.95 seconds. If in that time period, a flame test period, no flame is detected, the third time constant 48 discharges causing a high output to be produced by NAND driver 46 on line 47 which disables motor driver circuit 22 and removes the AC voltage 25 from the blower motor 16 thus stopping the operation of the system. In such case, to attempt a restart, the switch 27 must be opened to initialize all circuits and then closed to attempt to restart.

If however a flame has been detected by photocell 18 and a proper signal is present on line 52, photocell flame control circuit 50 will provide intermittent pulses on line 54 through diode 56 to the third time constant circuit 48 to maintain it in its charged state thus providing the proper output signal from NAND driver 46 on line 47 to cause switch 22 to maintain the AC voltage applied to the blower motor 16.

After the first time constant 32 expires, the output of NAND gate driver 36 on line 38 is coupled through diode 39 to the input of NAND gate driver 42 which causes a low output on line 44 through diode 45 to the third time constant 48. If time constant circuit 48 has not received an input from the photocell flame control circuit 50, it will discharge in less than 1 second thus removing power to the blower motor 16 as explained earlier.

Thus there are several advantages obtained over the prior art by using the circuit of FIG. 1 as described. First, the use of a hot surface ignitor with oil burning systems is novel. They have been used with gas systems but not with oil because of the reason of carbon formation that inhibits their use after a few cycles. Second, the use of AC line voltage being applied to both the ignitor and the blower motor provides a versatility that has not been found with prior art units. Third, the use of low voltage DC for the control circuits provides simplicity and economy in the construction of the control circuits while allowing the high voltage alternating current to be used as the power source for the ignitor and the blower motor. Fourth, the use of the three time constant circuits is novel. The first time constant circuit preheats the hot surface ignitor and, at the end of the preheat period, the second time constant circuit 34 turns ON the blower motor for providing fuel and air. At the end of the ignition trial period, the first time constant generates an output through diode 39 and NAND gate 42 to cause the third time constant 48 to discharge if a flame has not been detected. If the third time constant circuit 48 discharges within the less-than-one-second period, the output of driver 46 on line 47 opens the switch 22 and removes the power to the blower motor 16. This less-than-one-second discharge time of the third time constant 48 is called a flame test period.

Figure 2:
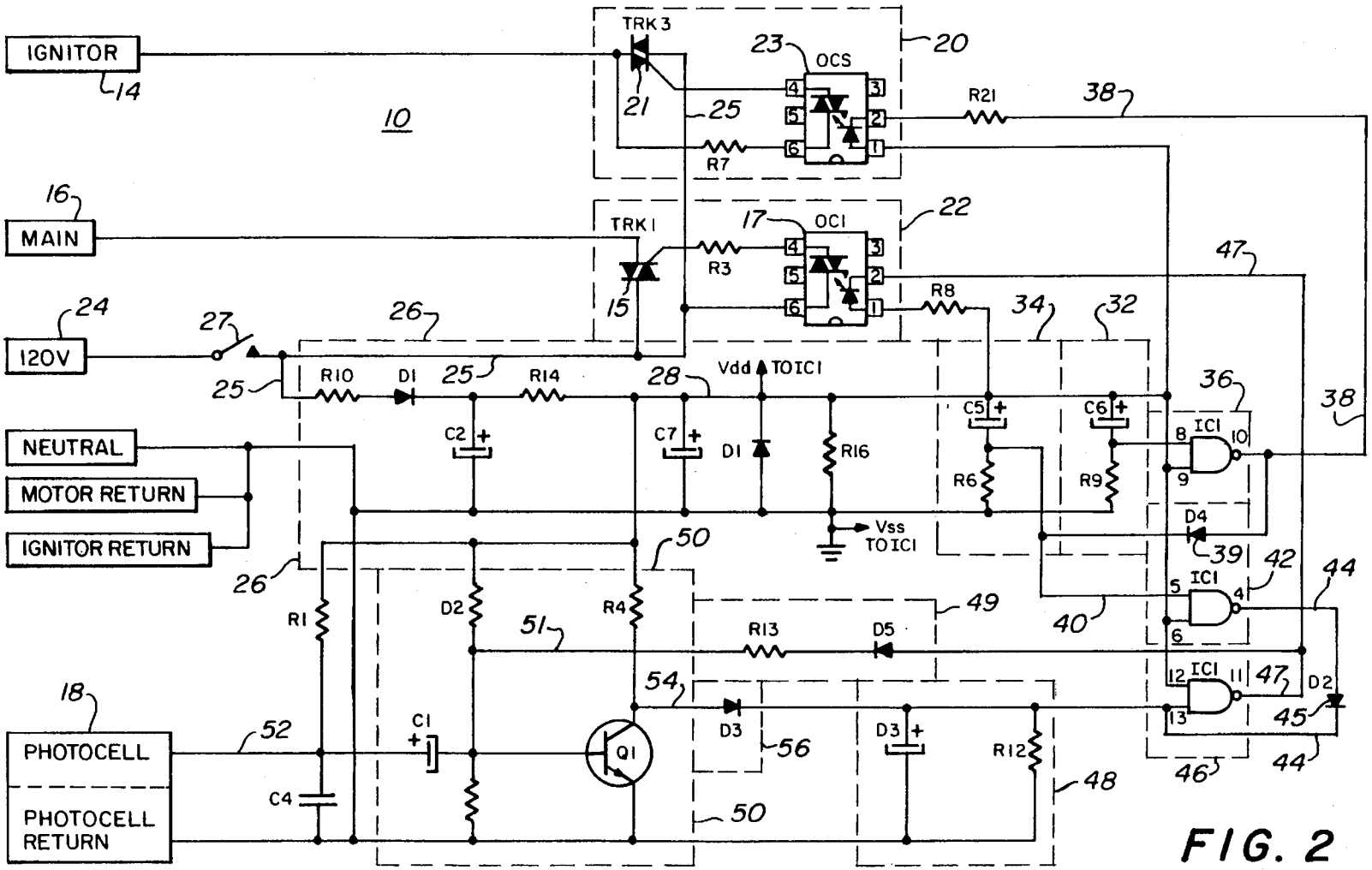
FIG. 2 is a corresponding circuit diagram of the invention.

Further, the photocell flame control circuit 50 functions in a unique manner as will be seen hereafter in relation to FIG. 2. Finally, to insure that there is no buildup of fuel in the combustion chamber 12 when the "no flame" condition is detected by the third time constant 48, the output signal from driver 46 on line 47, that removes power to the blower motor, is also coupled through a lock-out circuit 49 on line 51 to the photocell flame control circuit 50 to disable it so that it cannot be used to provide a false signal to the third time constant to maintain the blower motor 16 and perhaps cause accidental injury to service persons due to accidental restart of motor.

FIG. 2 discloses the details of the block diagrams of FIG. 1 and is a complete circuit diagram of the present invention. As can be seen in FIG. 1, during power-up, when switch 27 is closed, the AC line voltage at 24 is coupled on line 25 to the ignition driver 20, the motor driver 22 and the AC-to-DC converter 26. Twelve volts are produced by the AC-to-DC converter circuit 26 on line 28. As soon as the CMOS logic threshold is reached, the first time constant circuit 32 and the second time constant circuit 34 begin to charge. The junction of capacitor C6 and R9 in the first time constant circuit 32 is coupled as an input to NAND gate 36. The other input is the 12 volts DC. This causes the output on pin 10, line 38, to go essentially to ground potential. This ground potential on line 38 is coupled to an optical circuit 23 in the ignitor driver circuit 20 causing a gate voltage to triac 21 and turning it on. This couples the AC line voltage to the ignitor 14 and begins the preheat stage.

At the same time, the second time constant circuit 34 has developed a decreasing voltage at the junction of C5 and R6 on line 40. This voltage is coupled as one input to the second NAND gate 42. Again, the other input is the 12 volts DC. This causes a low output from NAND gate 42 on line 44 through diode 45 as an input to the third NAND gate 46 until the time constant voltage decays to a level that turns ON gate 42. Because this is a low input to NAND gate 46, when the second time constant circuit 34 starts to decay, a high output is developed on line 47 and coupled to motor driver circuit 22. A high output cannot enable the circuit since a ground is required. However, when the voltage from the second time constant has decreased to the CMOS level of its logic threshold, NAND gate 42 produces a high output on line 44 that is coupled to diode 45 as an input to third NAND gate 46. This causes a low output on line 47 to the motor driver circuit 22. It activates the optical circuit 17 that provides a gate voltage to triac 15 that conducts and couples the AC line voltage to the fan motor and fuel and air are provided to the combustion chamber.

At the same time that the high output from second NAND gate 42 is energizing the third NAND gate 46 to start the fan blower motor, it is also charging third time constant circuit 48 containing parallel capacitor C3 and resistor R12. This time constant circuit is very fast and lasts for a time period from 0.6 to 0.95 seconds. The third time circuit 48 starts to discharge at essentially the same time that the first time constant circuit 32 expires. When it expires, a low signal is input to the first NAND gate 36 causing a high output on line 38 which removes heat to the ignitor 14. It is also coupled through diode 39 to line 40 to force NAND gate 42 to have a low on output line 44 through diode 45 to the input of third NAND gate 46 as well as to third time constant circuit 48. If no flame has been detected by that time, the third time constant circuit 48 discharges to a low voltage thus causing a high on the output of third NAND gate 46 on line 47 to disable the driver gate 22 and remove the power to the blower motor 16. Thus the unit is disabled. At the same time, the disabling output on line 47 from third NAND gate 46, which is a high signal, is coupled through lock-up circuit 49 comprised of a diode D5 and a resistor R13 to produce an output on line 51 that is coupled to the base of the transistor Q1 in the photocell flame control circuit 50. This large signal turns transistor Q1 ON and essentially grounds line 54 to the diode 56 thus ensuring that third time constant circuit 48 cannot be charged through the transistor Q1 in the photocell flame control circuit 50. Thus the circuit is effectively disabled and locked in that state.

To restart, switch 27 has to be opened, all of the circuits initialized and the switch 27 reclosed to commence the restart process all over again.

If, during the flame test period immediately following the ignition trial period, a flame is detected by photocell 18, the signal on line 52 is coupled through capacitor C1 to the base of transistor Q1 in the photocell flame control circuit 50. Since the photocell 18 produces an AC output voltage, because of the flickering or fluctuating flames, if the peak-to-peak amplitude of the output from the photocell 18 is sufficiently high, the negative going pulses will be applied through capacitor C1 to the base of Q1 thus turning it OFF. When it is turned OFF, the 12 volts DC signal on line 28 is coupled through resistor R4 to the diode 56, charges capacitor C3, and thus the third time constant circuit 48. Thus during every negative cycle of the waveform being received from the photocell 18, typically a 30 hertz dominate frequency, the transistor Q1 will be shut OFF to allow a DC voltage from a DC voltage power supply on line 28 through R4 to be used to charge capacitor C3 that, it will be recalled, is discharging rapidly. As long as the frequency period is within a sufficient range to enable the capacitor C3 to be continuously recharged faster than it is discharging on the positive cycle, the blower motor will remain on.

In addition, the DC component of the flame signal from photocell 18 on line 52 is blocked by capacitor C1 so that ambient light cannot activate the circuit. However, if the flame is so low that the peak-to-peak amplitude of the signal being passed through C1 is not sufficient to overcome the bias on the base of Q1 and turn it OFF, then the capacitor C3, and the third time constant 48, will discharge and the unit will be turned OFF. Thus both frequency and the peak-to-peak amplitude of the signal detected by the photocell and coupled on line 52 to transistor Q1 must be within a predetermined range in order for the circuit to continue to keep power to the blower motor.

Again, the first time constant 32 has a time constant period of approximately 10 seconds. The second time constant circuit 34 has a time constant period of approximately 5 seconds and the third time constant circuit 48 has a time constant period of approximately 0.6 to 0.95 seconds. In addition, it can be seen in FIG. 2 that the output of the NAND gate 46 on line 47, when it is high and disables the blower motor circuit 22, is also coupled through the lock-up circuit 49 and diode D5 to bias the base of transistor Q1 in the photocell flame control circuit 50 to prevent it from being turned ON by any spurious signals. Thus the circuit is locked to prevent a restart without removal of the AC voltage through switch 27.

Thus in summary, on power-up the DC power supply voltage goes from 0 to 12 volts. As soon as the CMOS logic threshold is reached, the three NAND gates 36, 42, and 46 are initialized. NAND gate 36 turns ON the triac 21 in the ignitor drive circuit 20 which delivers AC line voltage to the ignitor assembly 14. After approximately 4.5 to 5.5 seconds, the ignitor preheat time, third NAND gate 46 turns ON triac 15 in the blower motor drive circuit 22 which delivers AC line voltage to the motor 16. The ignitor 14 remains turned ON for approximately 3.5 to 5 more seconds, the ignition trial time, prior to being turned OFF by the dissipation of the first time constant circuit 32. When the blower motor 16 is turned on, it delivers air to a siphon nozzle, well known in the art, which draws fuel oil up from a supply source while at the same time the fan attached to the motor shaft forces secondary combustion air into the combustion chamber assembly. During the ignition trial period, if all systems are "go", the atomized fuel is lit by the ignitor 14 and a flame will be established in the chamber 12. The photocell 18 is positioned at the back of the chamber to monitor the flame in the chamber 12. If the photocell 18 senses an adequate amount of flame in the chamber, a multifrequency, variable amplitude flame signal is fed into the photocell flame control circuit 50 and the blower motor drive circuit 22 will remain turned on. If for some reason an adequate flame in the chamber is not established, blower motor driver circuit 22 will be turned OFF by NAND gate 46 within 1 second after the ignition trial period has expired by reason of the third time constant 48. After a "normal shutdown" due to an out-of-fuel condition, for example, the control goes into a lock-out mode for safety considerations by the signal through lock-out circuit 49 at which time the blower motor cannot be turned ON unless power is removed and then reapplied through switch 27.

While the invention has been described in connection with a preferred embodiment, it is not intended to limit the scope of the invention to the particular form set forth, but, on the contrary, it is intended to cover such alternatives, modifications, and equivalence as may be included within the spirit and scope of the invention as defined by the appended claims.

I claim:

1. A fuel oil type burner including:

a fuel oil combustion chamber;

a power source for providing at least 100 volts AC;

a hot surface ignitor electrode associated with said combustion chamber, said ignitor electrode being sintered to full density with essentially no porosity;

a fan blower driven by a motor for providing fuel oil and air to said combustion chamber;

an AC/DC converter coupled to said AC power supply for providing a DC voltage output;

a first controllable switch coupled between said AC power source and said hot surface ignitor;

a second controllable switch coupled between said AC power source and said fan blower motor;

a flame detector associated with said combustion chamber for generating an electrical signal if a flame is detected; and a control assembly coupled to said DC output voltage, said flame detector and said first and second controllable switches for energizing said first controllable switch to heat said hot surface ignitor with said AC voltage for both a first predetermined preheat period and a second predetermined trial ignition period, energizing said second controllable switch to operate said blower motor with said AC voltage only during a second predetermined trial ignition period, said fan blower motor being energized with said AC voltage only at the beginning of said trial ignition period and continuing for a flame test period immediately following said trial ignition period and de-energizing said fan blower motor if no ignition occurs during said flame test period.

2. A fuel oil burner as in claim 1 wherein such control assembly includes:

a first time constant circuit for generating a first signal to said first controllable switch for coupling said AC voltage to said hot surface ignitor to preheat said ignitor for a first predetermined period of time and to cause said ignitor to maintain said preheat condition for a second predetermined trial ignition period of time;

a second time constant circuit for generating a second signal to said second control switch to coupled said AC voltage to said blower motor beginning with said second predetermined period of time; and a third time constant circuit associated with said second time constant circuit for causing said fan blower motor to continue to operate if a flame is detected or to de-energize said blower motor if said flame is not detected within a predetermined third period of time.

3. A fuel oil burner as in claim 1 further including:

a photocell as said flame detector, said photocell producing an AC output signal having a DC component that is affected by ambient light, an AC peak-to-peak amplitude that depends on the amount of flame, and a frequency depending upon the fluctuation of the flame.

4. A fuel oil burner as in claim 3 wherein said control assembly further includes:

a photocell flame control circuit for generating output signals for energizing and de-energizing said fan blower motor depending upon said detected flame; and a capacitor for receiving said photocell output signal for said flame control circuit, blocking said DC voltage component generated by said photocell, and preventing said fuel oil burner blower motor from being energized by said DC level because of ambient light.

5. A fuel oil burner as in claim 4 wherein said control assembly further includes:

a first drive circuit coupled to said first controllable switch;

said first time constant circuit being coupled to first drive circuit for generating said first signal to cause said ignitor to preheat for said first predetermined time period and to continue heating for said second predetermined trial ignition time period;

a second drive circuit coupled to said blower motor;

said second time constant circuit being coupled to said second drive circuit for energizing said blower motor and providing said fuel oil and air at the beginning of said second trial ignition time period; and said third time constant circuit being coupled between said photocell and said second drive circuit for maintaining said blower in said energized state if said flame is detected by said photocell no later than the expiration of said third flame test period of time.

6. A fuel oil burner as in claim 5 wherein said photocell flame detection circuit further includes:

a sensing circuit for receiving and sensing said photocell AC peak-to-peak amplitude and said frequency depending on the fluctuation of said flames to maintain said third time constant circuit in a charged state if said AC peak-to-peak amplitude and said flame frequency are within predetermined limits.

7. A fuel oil burner as in claim 6 wherein said sensing circuit includes:

a transistor coupled to said third time constant circuit and biased to the ON condition to provide an insufficient signal to maintain said charge on said third time constant circuit, and an OFF condition to provide a signal to maintain said charge on said third time constant circuit; and said capacitor being coupled to said transistor such that a flame signal of amplitude and frequency within said predetermined range limits turns said transistor OFF with each cycle of said signal frequency so as to maintain said charge on said third time constant circuit thereby maintaining said blower motor in the energized state.

8. A fuel oil burner as in claim 6 wherein said sensing circuit is frequency sensitive.

9. A fuel oil burner as in claim 6 wherein said sensing circuit is amplitude sensitive.

10. A fuel oil burner as in claim 8 wherein when said flame frequency is within said predetermined range, said third time constant circuit remains charged and when said flame frequency is lower than said predetermined limits, said third time constant discharges thus allowing the blower motor to be de-energized.

11. A fuel oil burner as in claim 7 further including:

a lock-out circuit coupled between said second drive circuit and said photocell flame control circuit such that when a flameout occurs during operation, said lock-out circuit turns said transistor ON and fails to charge said third time constant circuit thus de-energizing said blower motor.

12. A fuel oil burner as in claim 7 wherein said lock-out circuit further includes a diode between said flame control circuit and said second driver circuit for providing a bias voltage to said transistor to prevent said transistor from being turned OFF to provide a charging voltage to said third time constant circuit so as to prevent accidental restart of the motor.

* * * * *